United States Patent [19]

Nissen et al.

[11] Patent Number: 4,489,518

[45] Date of Patent: Dec. 25, 1984

[54] SEALING ARRANGEMENT FOR TILTABLE AND PIVOTAL WINDOWS

[75] Inventors: Knud E. Nissen, Hornsyld; Erik S. Berneke, Copenhagen, both of Denmark

[73] Assignee: V. Kann Rasumussen Holding A/S, Søberg, Denmark

[21] Appl. No.: 575,892

[22] Filed: Feb. 1, 1984

[30] Foreign Application Priority Data

Feb. 14, 1983 [DK] Denmark ..... 630/83

[51] Int. Cl.[3] ..... E06B 1/00

[52] U.S. Cl. ..... 49/392; 49/393

[58] Field of Search ..... 49/392, 393, 391, 390

[56] References Cited

U.S. PATENT DOCUMENTS 2,360,790 10/1944 Pergolizzi et al. ..... 49/392 X 2,455,642 12/1948 Baer ..... 49/392 X 2,758,681 8/1956 Leeser ..... 49/392

FOREIGN PATENT DOCUMENTS 877302 9/1961 United Kingdom .....E04f 988469 4/1965 United Kingdom.

*Primary Examiner*—Philip C. Kannan

*Attorney, Agent, or Firm*—Lane, Aitken & Kananen

[57] ABSTRACT

In a tiltable or pivotal window in which the frame and sash side members that are perpendicular to the axis of rotation have oppositely facing abutment surface sections on either side of the axis area, said abutment surface sections merge smoothly into each other through an abutment surface section formed as a helical surface of about 180°. A continuous weather strip may be provided on one or both of the abutment surfaces. If such strips are provided on both surfaces, they may be magnetic with opposite transverse polarization to improve tightness and minimize sliding contact between the strips in the helical surface area.

2 Claims, 6 Drawing Figures

SEALING ARRANGEMENT FOR TILTABLE AND PIVOTAL WINDOWS

FIELD AND BACKGROUND OF THE INVENTION

This invention relates to a sealing arrangement for tiltable and pivotal windows of the kind in which both the frame and sash have abutment surface sections facing in opposite directions on either side of the axis of rotation, at least one of the abutment surfaces being provided with a weather strip to improve the tightness in the closed position of the window.

Such a sealing arrangement is for instance known from the specification of British Pat. No. 877,302 which makes it clear that in windows of the kind concerned (i.e. with a window sash which is rotatable about a horizontal or vertical axis positioned between, ordinarily approximately midway between, the frame members parallel to the axis) a particular sealing problem between frame and sash arises in the area of the axis where two joints intersect, viz. the longitudinal joint between the associated frame and sash members, and the transverse joint between the opposite ends of the rabbets or abutment strips of the frame and the sash, respectively. The patent specification discloses a solution including the use of a channel-shaped weather strip composed of two pieces, one of which has one longitudinal edge portion inserted between the sash member and its rabbet or abutment strip while its other longitudinal edge portion seals against the frame when the window is closed, and vice versa as far as the other weather strip piece is concerned. The weather strip also overbridges the said transverse joint in the closed position of the window, either in the way that its two pieces overlap each other at this joint or by providing a tight end abutment between both weather strip pieces. It is, however, considered a drawback that the weather strip must necessarily consist of two separate pieces, because on either side of the region of the axis, it must be secured to the stationary frame and to the movable sash, respectively.

FIG. 4 of the British Pat. No. 988,469 illustrates another proposal for solving the particular sealing problem in tiltable and pivotable windows, viz. by using a resilient weather strip of T-shaped cross-section, the head portion of the strip being continuous while its web portion is cut through at the axial region of the window and on opposite sides thereof is secured to the frame portion and to the sash portion, respectively. A primary condition of realizing this proposal is that the axis of the window passes through or at any rate is spaced only slightly from the head portion of the T-shaped weather strip as, otherwise, this portion will be longitudinally stretched or compressed rather strongly by maximum tilting or rotation of the window sash in the frame. Such an axis positioning may however cause drawbacks in other respects, in particular if the window shall be provided with external cover rails which in the closed position should overlap each other in the area of the axis. Even with the indicated positioning of the axis in relation to the head portion of the weather strip member, this portion will however be strongly deformed by bending when the window opens, thereby entailing that the lifetime of the weather strip may be shorter than intended.

SUMMARY OF THE INVENTION

Starting from this proposal, the invention solves the problem of provided a sealing arrangement as specified in the foregoing and which may include a continuous weather strip which will neither be subjected to any deformation by the tilting or rotation of the window sash nor be subjected to damage due to such deformations.

The sealing arrangement according to the invention is characterized in that the said abutment surface sections of the frame and sash members, respectively, that are perpendicular to the tilting or pivoting axis merge smoothly into each other through a substantially helically wound abutment surface section, the centre of which, represented by the point where the generatrix of the helical surface is perpendicular to the plane of the window, lies at least approximately in a plane perpendicular to the window and including the tilting or pivotal axis.

In this case no particular demands are made on the positioning of the tilting or pivotal axis which consequently, as is ordinary per se, may be spaced a suitable distance outwardly or inwardly from the main plane of the window. Neither are particular demands made on the strength and flexibility of the weather strip or strips, as they are not, subsequent to their being mounted, subjected to any deformation, except that they may be slightly compressed when the window sash is pulled into its closed position. If ordinary weather strips of rubber or rubber-like material are used and for instance of a more or less rectangular cross-section, they shall only while being mounted be subjected to a (permanent) twisting deformation so as to conform to the associate abutment surface of the frame or sash member but this will give rise to no difficulties in practice unless the helicoidal abutment surface section is so short in comparison with the twist angle that the twisting of the weather strip per length unit exceeds the allowed value. However, the abutment surface section concerned may be made arbitrarily long or the twist angle suitably small, for instance 90° or less, so that the twist of the weather strip per length unit is easily kept at a quite harmless value and, finally, the weather strip may, if desired, be moulded so that it is born to fit closely to the abutment surface.

DETAILED DESCRIPTION OF THE PREFERRED EMBODIMENT

Figure 1:
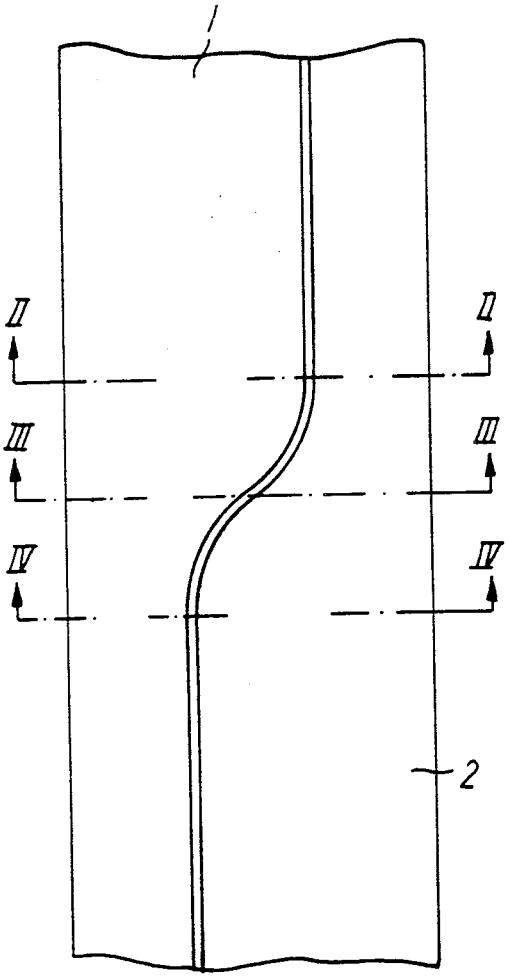
FIG. 1 shows the centre portions of a pair of associate frame and sash members of a tiltable window, seen from its outside.
Figure 2:
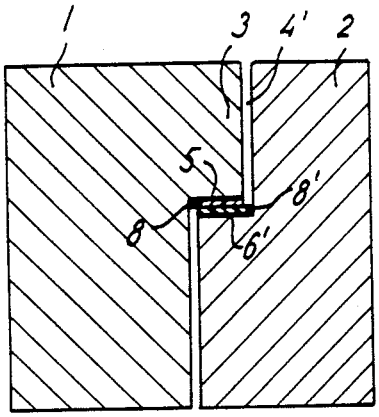
FIGS. 2, 3 and 4 are cross-sections along the lines II—II, III—III and IV—IV in FIG. 1.
Figure 3:
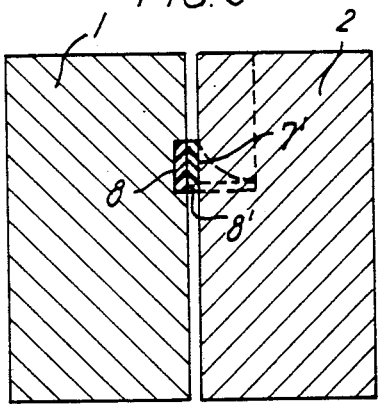
Figure 4:
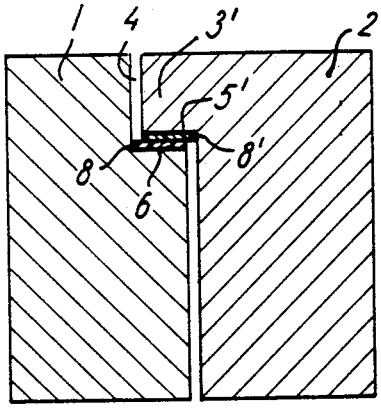

In the drawings 1 designates the frame of the window and 2 its sash mounted in the frame by means of hinges, not shown, which are supposed to determine a tilting axis positioned somewhat outside the external surface of the window, i.e. somewhat above the external surfaces facing upwardly in FIGS. 2 to 4 of the frame and sash members. The projection of the axis on the plane of the drawing in FIG. 1 may be coincident with or lie close to the sectional line III—III.

Figure 5:
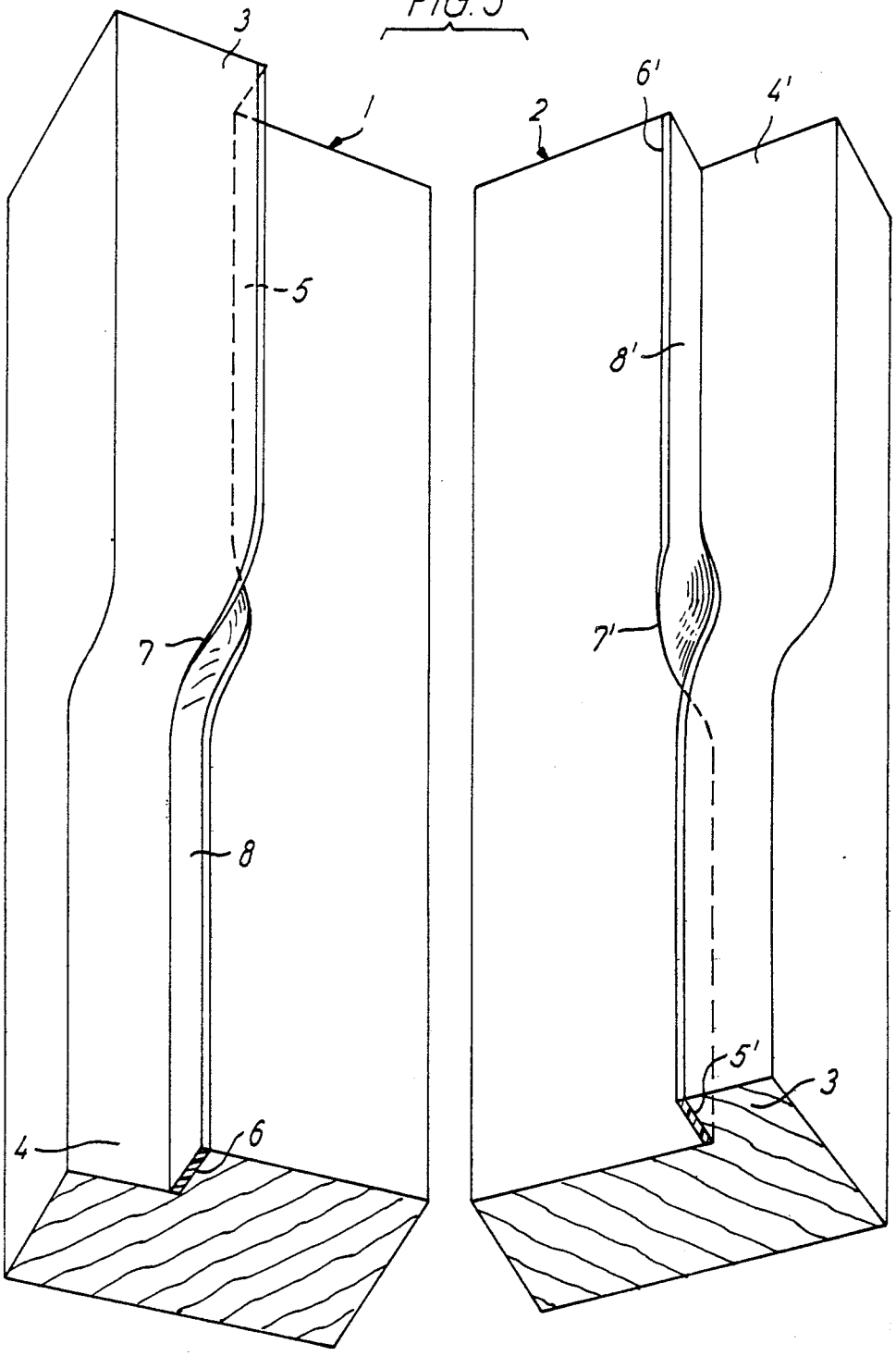
FIG. 5 is a perspective view of the two frame and sash member portions detached from each other.

Above the sectional lines II—II and below the sectional line IV—IV the frame member has an abutment portion 3 protruding towards the sash member 2, FIGS. 2 and 5, and an abutment groove or rabbet 4, FIGS. 4 and 5, respectively, thereby provided an inwardly facing abutment surface section 5 and an outwardly facing abutting surface section 6, respectively. These abutment surface sections merge smoothly into each other through a twisted abutment surface section 7 which is formed as a helical surface of 180°. The centre of said section 7 is located at the sectional line III—III, and as it will best appear from FIG. 3 the generatrix of the helical surface at this point is perpendicular to the window plane, while the abutment sections 5 and 6 are both parallel to the same plane.

The sash member 2 is similarly formed but yet so that the abutment portion 3' with the abutment surface section 5' is situated below the axis area and the abutment rabbet 4' with the abutment surface section 6' above the same area.

A weather strip 8 is secured, for instance by glueing, to the abutment surface 5, 7, 6 of the frame member, said weather strip having, as shown, a relatively flat rectangular cross-section and being twisted so that one of its surfaces conforms fully to the abutment surface. A similar weather strip 8' may be provided on the abutment surface of the sash member 2, but one weather strip member will do which can then be given an increased thickness.

The weather strips 8 and 8' may be compressible in a direction perpendicular to the abutting surfaces and they may further, in a known manner, be permenantly magnetic with opposite transversal polarization so that their adjacent surfaces attract each other in the closed position of the window whereas they repel each other in the sections 7 and 7' when the sash opens and closes. This ensures perfect sealing also in the critical area, and at the same time the sliding contact between said sections of the weather strip member is eliminated or reduced to a minimum.

As already mentioned the axial length of the abutment surface section 7 may vary considerably, and the same applies to its total twisting. As stated above, the twist in FIGS. 1 to 5 amounts to 180° and it is distributed evenly along the length, but this feature is not either obligatory.

Figure 6:
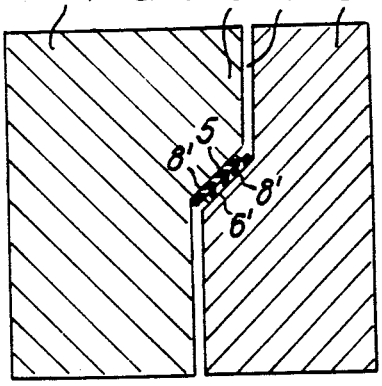
FIG. 6 is a cross-section analogous to FIG. 2 but with a total twist angle of about 90° instead of 180° as supposed in FIGS. 1 to 5.

Particularly, in some cases it may be preferred that the total twist angle is smaller, for instance 90°, as shown in FIG. 6. This requires a corresponding smaller twist of the weather strip member 8,8', and the abutment surfaces 5,6 and 5', 6' inclined in relation to the window plane, may then contribute to guide the window sash home during the last part of the closing movement and may facilitate the configuration of the weather strips at the four corners of the window.

We claim:

1. A window having a stationary rectangular frame including four frame members, a sash having corresponding sash members and being swingable around an axis extending parallel to and located intermediate an opposed pair of said frame members, and at least one weather strip to improve the tightness between said frame and said sash in the closed position of the window, each of the frame and sash members extending perpendicular to said axis presenting abutment surface sections facing in opposite directions on either side of the axis, said abutment surface sections of the frame members as well as those of the sash members merging smoothly into each other via a substantially helically wound abutment surface section having its centre, represented by the point at which the generatrix of the helical surface is perpendicular to the plane of the window, located at least approximately in a plane perpendicular to the window and including said axis.

2. A window as claimed in claim 1, wherein each of said helically wound abutment surface sections has a total twist of not more than 180°, preferably about 90°.

* * * * *